United States Patent [19]

Vecchiarelli

[11] 4,245,688

[45] Jan. 20, 1981

[54] CORD LOCK FOR A VENETIAN BLIND LIFT CORD

[75] Inventor: Francis Vecchiarelli, River Edge, N.J.

[73] Assignee: Hunter Douglas International N.V., Netherlands Antilles

[21] Appl. No.: 43,695

[22] Filed: May 30, 1979

[51] Int. Cl.[3] ..... E06B 9/38

[52] U.S. Cl. ..... 160/178 C

[58] Field of Search ..... 160/166–178 R, 160/178 C

[56] References Cited

U.S. PATENT DOCUMENTS

| | | | |
|---|---|---|---|
| 3,040,403 | 6/1962 | Viol et al. | 160/178 C |
| 3,221,802 | 12/1965 | Hurkmans | 170/173 |

*Primary Examiner*—Peter M. Caun

*Attorney, Agent, or Firm*—Pennie & Edmonds

[57] ABSTRACT

A cord lock for a venetian blind lift cord, in which a fixed guide roller is mounted between front and rear plates, these plates being provided with generally H-shaped slots, the arms of the H being inclined towards one another upwardly, the slot accommodating, in the arms on one side, a locking roller slidable along the arms upon the cord rising to lock releasably the cord against the guide roller. The locking roller can be forced along the cross arm of the H onto the other arm, for use at the opposite end of the blind. A resilient wire separator for separating the lift cord from one another may be located on upstanding tabs provided with recesses on a curved edge surface, one of the recesses acting as a pivot point and the other as a locking recess.

9 Claims, 4 Drawing Figures

CORD LOCK FOR A VENETIAN BLIND LIFT CORD

BACKGROUND OF THE INVENTION

The present invention relates to a cord lock for a venetian blind lift cord.

Many forms of such lock have been proposed. In one simple arrangement the lift cord is locked between a fixed member and a locking roller, the locking roller being capable of sliding along a guide slot in the vertical direction under the action of the upwardly moving cord. The cord is thus clamped between the fixed surface and the locking roller.

In mounting such a construction in the headrail of a venetian blind, great care has to be taken to ensure that the lock is positioned the right way round depending on whether the lift cord is at the lefthand or righthand end of the head rail.

It is now proposed, according to the present invention, to provide a cord lock for a venetian blind lift cord, said cord lock comprising, in combination:

(a) front and rear plates maintained generally parallel to one another;

(b) a guide roller mounted between said front and rear plates, with its axis extending substantially normal to the front and rear plates;

(c) guide slots formed in the front and rear plates in register with one another, the guide slots including:

(i) side arms which are inclined towards one another in an upward direction, the axes of the side arms extending one on each side of the axis of the guide roller; and (ii) a cross arm joining the side arms and extending below the guide roller;

(d) a rotatable locking roller having end shaft portions mounted in the corresponding side arm of each guide slot and movable in the axial direction of the side arms in which they are mounted, effective to enable a cord passing around the guide roller and between the guide roller and locking roller to be releasably locked therebetween, the dimensions of the cross arms and locking roller shaft portions being such as to allow forceable movement only of the locking roller from one side arm to the other.

With such a construction, the locking roller is normally slidable in one of the side arms of each guide slot to carry out its locking action. If one wishes to mount the same lock at the other end of the blind, then the locking roller is simply forced through the cross arm to the other side arm of each slot. This is not normally possible during use of the cord lock. Thus, the supplier only has to stock one form of cord lock and this can be used at either end of the venetian blind headrail.

Preferably the guide roller and locking roller are dimensioned such that, when the locking roller is located at the lower end of the corresponding side arms of the guide slots, the free hanging cord, when moving upwardly, will itself engage and lock the locking roller. This can be achieved by making the dimensions of the guide roller and locking roller such that the nearest portion of the surface of the locking roller is spaced from the vertical plane including the axis of the guide roller by a distance about equal to the radius of the guide roller.

In order to facilitate the introduction of the guide roller into the lock, the rear wall advantageously extends upwardly beyond the front wall and an aperture is formed in the front wall with an elongate slot having its axis extending vertically being provided in the rear wall, the elongate slot also extending upwardly beyond the front wall. The elongate slot has a lower end in register with the aperture, so that the aperture and the slot can each receive a shaft end portion of the guide roller. In the assembly operation, the rear shaft portion of the guide roller is inserted in the upper end of the slot, and the front plate is pulled forwardly and the guide roller allowed to move downwardly until the forward shaft portion can be engaged in the aperture.

To facilitate the introduction of the lock into the headrail of a venetian blind, the rear wall preferably extends upwardly beyond the front wall and a rearwardly extending locking surface is provided adjacent the upper end of the rear wall to engage under the rim of the rear flange of a venetian blind headrail, a forwardly projecting tab on the front wall, adjacent the lower end thereof, being provided to engage in an aperture in the front wall of the headrail, the locking surface comprising a curved portion enabling the locking surface to engage under the rim by snap-in action upon pivoting of the lock about the tab.

According to a further aspect of the invention, there is provided a cord lock for a venetian blind lift cord, said cord lock comprising, in combination:

(a) front and back plates;

(b) cord locking means mounted between said front and back plates;

(c) a tab extending transverse to the front and back plates adjacent each side thereof;

(d) a correspondingly shaped curved edge surface on each tab;

(e) aligned pivot forming recesses in the edges of said tabs;

(f) aligned locking recesses in the edges of said tabs at a location spaced along the curved edge from the associated pivot forming recess; and (g) a resilient wire separator, for separating lift cords from one another, said separator including a pivot portion engaged in the pivot forming recess and a locking portion slidable over the curved edge surface, upon pivoting of the separator about the pivot portion, whereby the locking portion can be resiliently engaged in said locking recess.

With such a construction the wire separator, which is used to separate two or more lift cords from one another, is housed completely within the headrail and is therefore kept out of view. The method of mounting is extremely simple and inexpensive.

In order that the present invention may more readily be understood, the following description is given of a presently considered preferred mode of putting the invention into effect, reference being made to the accompanying drawings.

DETAILED DESCRIPTION OF THE PREFERRED EMBODIMENT

Figure 1:
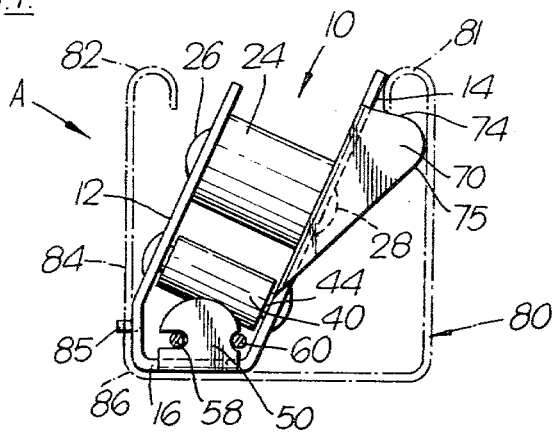
FIG. 1 is a side elevation of one embodiment of cord lock according to the invention, shown mounted in a venetian blind headrail.

The cord lock illustrated in FIG. 1 is indicated by the general reference numeral 10 which includes a front plate 12 and a rear plate 14 connected by a base plate 16. The front and rear plates are generally parallel to one another, the rear plate having a portion 18 which extends above the top edge 13 of the front plate 12.

The rear plate 14 is provided with an elongate slot 20 which extends in a vertical plane beyond the upper edge 13 of the front plate 12 while the front plate is provided with an aperture 22 which is in register with the lower portion of the slot 20.

A guide roller 24 having front and rear shaft portions 26, 28 is mounted between the front and rear plates by inserting the rear shaft portion 28 into the upper end of the slot 20, by pulling forward the front plate 12 slightly, and lowering the guide roller 24 until the front shaft portion 26 engages in the aperture 22, whereupon the front plate is released. The shaft portions 26, 28 are then peened over to fix the roller 24 so that it cannot rotate.

The front and rear walls are each provided with a guide slot 30, the two guide slots being in register with one another. Each guide slot is of a substantially H-shaped configuration, with the arms 32, 34 inclined towards one another upwardly. Thus, the axes of the arms 32, 34 are inclined towards the axis of the roller 24, in the upward sense. The guide slot is completed by a cross arm 36 which is shown with a constriction 38 at its centre.

A knurled locking roller 40 has front and rear shaft portions 42, 44 which are shown engaged in the side arms 32 to the right of the axis of the guide roller 24. The dimensions of the shaft portions 42, 44 are such that the shaft cannot be passed through the cross arm 36, or at least past the constrictions 38, without being forced through. This effect could equally be achieved by carefully selecting the width of the cross arm 36 to prevent the movement again without forcing.

The base plate 16 has upturned tabs 50, one at each end. The two tabs are identical and have a curved upper surface 52, a pivot forming recess 53 and a locking recess 54 formed within the curved surface.

Figure 4:
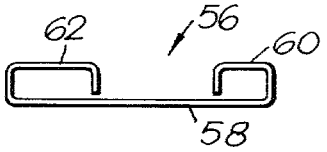
FIG. 4 is a plan view of the wire separator itself.

A wire separator 56 for the lift cords of a venetian blind is illustrated in FIG. 4. This comprises a straight portion 58, and two end portions 60 and 62 formed into rectangles, one rectangle being located at each end. The wire separator is mounted on the tabs 50 by engaging the portion 58 in the pivot forming slot 53, the portion 58 thus forming a pivot portion. The separator is then pivoted so that the portions 60 and 62 engage the curved surfaces 52 of the tabs. It will be noted that these curved surfaces increase their spacing from the pivot forming recess towards the locking recess, so that the rectangular portions 60 and 62 are resiliently opened and snap back into engagement with the locking recess.

The rear plate 14 is provided with two rearwardly extending wings 70 and 72 (FIGS. 1 and 2), these each having an upper rearwardly extending locking surface 74 having a curved portion 75 at the rear. When the lock is to be engaged in the head rail of a venetian blind, which is indicated in FIG. 1 by the reference numeral 80 and which has upper rims 81 and 82, the lock is inserted so that the front and rear plates 12 and 14 are nearly vertical, and a tab 85 is engaged in a corresponding aperture in the front wall 84 of the head rail. The lock is then pivoted so that the curved surface 75 engages and flexes back slightly the rim 81 which then snaps back to hold the lock in place by engagement with the locking surface 74.

An aperture 86 is indicated in the headrail 80 for the passage of the lift cords, one lift cord going on one side of the wire portion 58 and the other between the wire portion 58 and the portion 60, so that the two cords are separated from one another.

Figure 2:
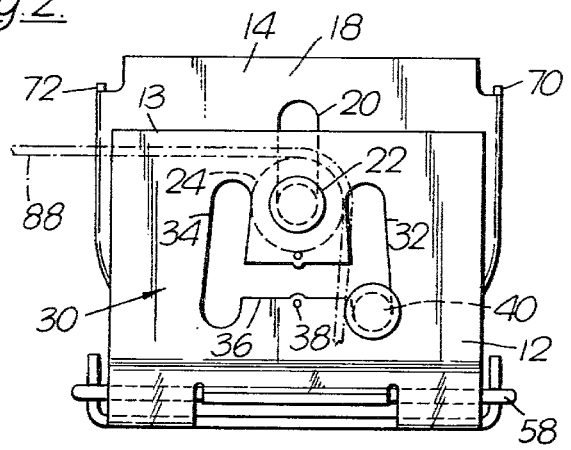
FIG. 2 is an enlarged fragmentary front elevation of a portion of the cord lock of FIG. 1.
Figure 3:
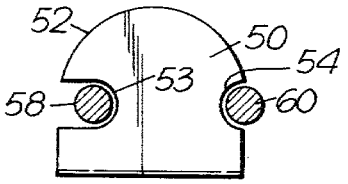
FIG. 3 is a side elevation of the tab for holding the wire separator of the cord lock of FIGS. 1 and 2.

Referring to FIG. 2 a cord 88 is indicated, this passing over the guide roller 24, the radius of which is approximately equal to the smallest or nearest spacing of the locking roller 40 from the vertical plane passing through the axis of the guide roller 24. This ensures that the cord hangs down in contact with the locking roller 40.

In operation, tension on the upper part of the lift cord, caused by the weight of the blind, pulls the cord upwardly and this raises the locking roller until it jams the cord between itself and the guide roller. When it is desired to lift or release the the blind, the cord is pulled downwardly, so that the locking roller drops. If it is desired to lower the blind the cord is then moved to the left so that it is maintained out of engagement with the locking roller and the cord is then allowed to run at this angle.

The guide rollers in the front and back plates have been indicated as generally H-shaped. However, they may have the cross arm at a lower location, so that they are, for example, channel-shaped, U-shaped or V-shaped.

I claim:

1. A cord lock for a venetian blind lift cord, said cord lock comprising, in combination:

(a) front and rear plates maintained generally parallel to one another;

(b) a guide roller mounted between said front and rear plates, with its axis extending substantially normal to the front and rear plates;

(c) guide slots formed in the front and rear ;lates in register with one another, the guide slots including:

(i) side arms which are inclined towards one another in an upward direction, the axes of the side arms extending one on each side of the axis of the guide roller; and (ii) a cross arm joining the side arms and extending below the guide roller;

(d) a rotatable locking roller having end shaft portions mounted in the corresponding side arm of each guide slot and movable in the axial direction of the side arms in which they are mounted, effective to enable a cord passing around the guide roller and between the guide roller and locking roller to be releasably locked therebetween, the dimensions of the cross arms and locking roller shaft portions being such as to allow forceable movement only of the locking roller from one side arm to the other.

2. A cord lock as claimed in claim 1, and further comprising a restriction in said cross arms, said restriction providing the dimension of the cross arm which cooperates with the dimension of the locking roller shaft portion such as to allow forcable movement only of the locking roller from one side arm to the other.

3. A cord lock as claimed in claim 1, wherein the guide roller and locking roller are dimensioned, such that, when the locking roller is located at the lower end of the corresponding side arms of the guide slots, the free hanging cord, when running upwardly, will engage and lift the locking roller.

4. A cord lock as claimed in claim 3, wherein the guide roller and locking roller are dimensioned such that the nearest portion of the surface of the locking roller is spaced from the vertical plane including the axis of the guide roller by a distance about equal to the radius of the guide roller.

5. A cord lock as claimed in claim 1, wherein the rear wall extends upwardly beyond the front wall and further comprising an aperture in the front wall and an elongate slot in the rear wall having its axis extending vertically, the elongate slot also extending upwardly beyond the front wall, said elongate slot having a lower end in register with the aperture, said aperture and slot end receiving a shaft portion of the guide roller.

6. A cord lock as claimed in claim 1, wherein the rear wall extends upwardly beyond the front wall, and further comprises a rearwardly extending locking surface adjacent the upper end of the rear wall to engage the rim of the rear flange of a venetian blind headrail and a forwardly projecting tab on the front wall, adjacent the lower end therof, to engage in an aperture in the front wall of the headrail, the locking surface comprising a curved portion enabling the locking surface to engage under the rim of the headrail by snap-in action upon tilting of the cord lock about the tab.

7. A cord lock for a venetian blind lift cord, said cord lock comprising, in combination:

(a) front and back plates;
(b) cord locking means mounted between said front and back plates;
(c) a tab extending transverse to the front and back plates adjacent each side thereof;
(d) a correspondingly shaped curved edge surface on each tab;
(e) aligned pivot forming recesses in the edges of said tabs;
(f) aligned locking recesses in the edges of said tabs at a location spaced along the curved edge from the associated pivot forming recess; and
(g) a resilient wire separator, for separating lift cords from one another, said separator including a pivot portion engaged in the pivot forming recess and a locking portion which, upon pivoting of the separator about the pivot portion, can be resiliently engaged in said locking recess.

8. A cord lock as claimed in claim 7, wherein the locking portion is slidable on the curved edge surfaces upon pivoting about the pivot portion, and the curved edge surfaces are shaped as cam surfaces of increasing spacing from said pivot forming recesses towards said locking recesses.

9. A cord lock as claimed in claim 7, wherein said wire separator is in the form of a single piece of wire bent to provide a straight section, and two end sections defining two loops spaced from one another and on the same side of said straight section.

* * * * *

UNITED STATES PATENT AND TRADEMARK OFFICE

CERTIFICATE OF CORRECTION

PATENT NO. : 4245688

DATED : January 20, 1981

INVENTOR(S) : Francis Vecchiarelli

It is certified that error appears in the above—identified patent and that said Letters Patent is hereby corrected as shown below:

Column 1, Line 51, "This is not" should read:
"This passage is not"

Claim 1, Column 4, Line 40, ";lates" should read:
"plates"

Signed and Sealed this

*Second* Day of *June 1981*

[SEAL]

*Attest:*

RENE D. TEGTMEYER

*Attesting Officer*

*Acting Commissioner of Patents and Trademarks*